US007967574B2

(12) United States Patent
Achten

(10) Patent No.: US 7,967,574 B2
(45) Date of Patent: Jun. 28, 2011

(54) VARIABLE PUMP OR HYDRAULIC MOTOR

(75) Inventor: Peter A. J. Achten, Eindhoven (NL)

(73) Assignee: Innas B.V. (NL)

( * ) Notice: Subject to any disclaimer, the term of this patent is extended or adjusted under 35 U.S.C. 154(b) by 169 days.

(21) Appl. No.: 11/853,449

(22) Filed: Sep. 11, 2007

(65) Prior Publication Data

US 2008/0060510 A1 Mar. 13, 2008

Related U.S. Application Data

(63) Continuation of application No. PCT/EP2006/060543, filed on Mar. 8, 2006.

(30) Foreign Application Priority Data

Mar. 11, 2005 (EP) ..... 05101934

(51) Int. Cl.
*F04B 1/32* (2006.01)

(52) U.S. Cl. ..... 417/269; 417/271; 60/492; 91/500; 91/502; 91/505; 91/506; 92/12.2; 92/13

(58) Field of Classification Search ..... 417/269, 417/271; 91/499, 500, 502, 504, 505, 506, 91/507; 92/12.2, 13, 57, 58; 60/487, 491, 60/492

See application file for complete search history.

(56) References Cited

U.S. PATENT DOCUMENTS

| | | | | |
|---|---|---|---|---|
| 2,968,286 | A * | 1/1961 | Wiggermann | 91/500 |
| 4,361,077 | A * | 11/1982 | Mills | 91/500 |
| 5,253,576 | A | 10/1993 | Bethke | |
| 6,109,034 | A * | 8/2000 | Larkin | 60/492 |
| 6,174,139 | B1 * | 1/2001 | Stolzer | 417/222.1 |
| 6,358,174 | B1 * | 3/2002 | Folsom et al. | 475/72 |
| 7,374,005 | B2 * | 5/2008 | Gray, Jr. | 180/165 |
| 7,470,116 | B2 * | 12/2008 | Dantlgraber | 417/269 |
| 2004/0022645 | A1 * | 2/2004 | Rousset | 417/269 |
| 2005/0017573 | A1 * | 1/2005 | Achten | 303/1 |
| 2005/0019171 | A1 | 1/2005 | Achten | |

FOREIGN PATENT DOCUMENTS

| | | |
|---|---|---|
| EP | 1 302 661 | 4/2003 |
| WO | 03/058035 | 7/2003 |

OTHER PUBLICATIONS

International Search Report, May 15, 2006, 2 pages.

* cited by examiner

*Primary Examiner* — Devon C Kramer
*Assistant Examiner* — Leonard J Weinstein
(74) *Attorney, Agent, or Firm* — St. Onge Steward Johnston & Reens LLC

(57) ABSTRACT

The invention concerns a variable pump or hydraulic motor with a drive shaft with a first axis of rotation and first plungers connected to the drive shaft and rotatable around the first axis of rotation. A port plate mounted in the housing can rotate around an axis intersecting the first axis, for adjusting the stroke volume. The port plate positioning drive comprises two counter-acting hydraulic actuators acting on the port plate in the direction of the first plungers.

13 Claims, 4 Drawing Sheets

VARIABLE PUMP OR HYDRAULIC MOTOR

CROSS-REFERENCE TO RELATED APPLICATIONS

The present application is a continuation of pending International patent application PCT/EP2006/060543, filed Mar. 8, 2006, which designates the United States and claims priority from European patent application no. 05101934.7, filed Mar. 11, 2005, the content of which is incorporated herein by reference.

FIELD OF THE INVENTION

The invention concerns a pump or hydraulic motor comprising a drive shaft with a first axis of rotation rotatably mounted in a housing, first plungers connected to the shaft and rotatable around the first axis of rotation, a port plate mounted in the housing and provided with a port plate surface with a high-pressure port at the first radius and a low-pressure port at a first radius each connected to a respective pressure line, a second axis of rotation which intersects the first axis of rotation in a centre plane, first cylinders rotatable around a second axis of rotation, and sealingly fitted around the first plungers for forming chambers with the first plungers, each chamber having a volume that in a full rotation of the first cylinders and first plungers changes according to a stroke volume, a plurality of cylinder channels each cylinder channel rotatable with a respective first cylinder and connected to a respective chamber and ending in a valve surface wherein the valve surface abuts and is rotatable relative to the port plate surface for connecting the chambers through respective cylinder channels with the high-pressure port or the low-pressure port, whereby a bearing supports each port plate in the housing and by rotating the port plate in the housing around a third axis of rotation which is perpendicular to the centre plane and intersects the first axis of rotation and the second axis of rotation, the stroke volume can be changed using a port plate positioning drive located in the centre plane exerting a force on the port plate.

BACKGROUND OF THE INVENTION

Such pumps or hydraulic motors are known as bent axis pumps or motors. The plungers of the known pumps or motors are swivable connected to a flange and are movable in cylinders, which are at one end of a rotor. At the other end of the rotor a port plate is positioned; this end of the rotor forms the valve surface. The port plate is located between the valve surface of the rotor and the housing. In the known pumps or motors, the port plate positioning drive comprises hydraulic actuators, which move a coupling pin in a slot in the housing. The coupling pin is positioned in a hole in the centre of the port plate so coupling the port plate to the hydraulic actuators.

This known construction has the disadvantage that in the centre plane at the location of the slot the housing does not support the port plate sufficiently so that the port plate can deform under influence of the high pressure between the port plate surface and the valve surface. Also between the pressure ports, which is in the area of the centre plane, the pressure between the port plate surface and the valve surface fluctuates with the passage of the cylinder channels and thereby causes fluctuations in the deformations. It is not possible to compensate for these fluctuations in the design of the parts. These fluctuating deformations create gaps, which cause leakage of oil. If the deformations are limited, for instance to a maximum of 3 to 5 micro millimeters, the leakage between the port plate surface and the valve surface remains acceptable. A higher value reduces the efficiency of the pump or motor in an undesirable way. This requirement limits the first radius, as a larger radius reduces the stiffness of the port plate and increases the deformations.

A further disadvantage of the known construction is that it is not possible to extend the drive shaft through an opening in the port plate. Such an extension would make it possible to connect several pumps or motors inline. An opening in the port plate with a diameter suitable for letting the drive axis pass through would further reduce the stiffness of the port plate and would interfere with the hydraulic actuators.

SUMMARY OF THE INVENTION

In order to overcome these disadvantages the pump or hydraulic motor further includes a port plate characterized in that the port plate positioning drive comprises a first hydraulic actuator and a second hydraulic actuator acting on the port plate in the direction parallel to the second axis of rotation and counteracting each other. Supporting the port plate in the centre plane using the hydraulic actuators reduces the deformations caused by the fluctuating high-pressure between the valve surface and the port plate surface, making it possible to overcome the disadvantages of the known design and to reduce leakage.

In accordance with an aspect of the instant invention, the pump or hydraulic motor further includes a first hydraulic actuator and a second hydraulic actuator which act on the port plate at a radius equal or larger than the first radius. In this way the hydraulic actuators directly support the area with the fluctuating pressure thereby further reducing the fluctuating deformations.

In accordance with an aspect of the instant invention, the pump or hydraulic motor further includes a first hydraulic actuator connected to a control unit and the second hydraulic actuator to the high-pressure port. By connecting the second actuator with the high-pressure port, it is necessary that the control unit keeps the first actuator under pressure as well. In this way it is ensured that both actuators support the port plate.

In accordance with an aspect of the instant invention, the pump or hydraulic motor further includes a port plate positioning drive which comprises a third hydraulic actuator which is connected to the first hydraulic actuator and which is placed opposite and counteracting the second hydraulic actuator. The first hydraulic actuator and the third hydraulic actuator work together, whereby the third hydraulic actuator directly compensates the force that the second hydraulic actuator exerts on the port plate. This leads to lower forces on the port plate and reduces deformations.

In accordance with an aspect of the instant invention, the pump or hydraulic motor further includes a port plate which comprises a first canal that connects the first hydraulic actuator and the third hydraulic actuator. In accordance with another aspect the port plate comprises a second canal that connects the second hydraulic actuator with the high-pressure port. This reduces the number of separate parts.

In accordance with an aspect of the instant invention, in the pump or hydraulic motor the forces exerted by the third hydraulic actuator on the port plate are parallel to the second axis of rotation. This way the torque for positioning or rotating the port plate is more or less independent of the rotational position of the port plate, so making positioning the port plate easier.

In accordance with an embodiment, the pump or hydraulic motor further includes hydraulic actuators which each comprise a second plunger mounted in the housing and a cup shaped second cylinder fitted around the second plunger sealing in a plane perpendicular to the second axis. In this way, the hydraulic actuators have a simple and cost effective design.

In accordance with an aspect of the instant invention, the pump or hydraulic motor further includes second cylinders which are slidable and/or sealingly supported on the port plate. This ensures that the second cylinders do not exert a sideways force on the port plate and that the design can be more compact by having canals in the port plate for supplying oil to the various cylinders.

In accordance with an aspect of the instant invention, the pump or hydraulic motor further includes a second cylinder and/or a port plate having spring and/or locking means for preventing a large gap between the second cylinder and the port plate. This ensures that during starting pressure build-up can take place in the high-pressure port and in the connected cylinders by pre-venting leakage through various gaps. After starting, the high pressure ensures that the gaps remain closed.

In accordance with an aspect of the instant invention, the variable pump or hydraulic motor further includes first plungers and first cylinders that are identical respectively with second plungers and second cylinders. This reduces the number of different parts in the device and eases production or maintenance of the pump or motor.

In accordance with an aspect of the instant invention, the variable pump or hydraulic motor further includes a port plate comprising first and second cylindrical bearing surfaces on a side of the port plate opposite from a side with the port plate surface for supporting the port plate in the housing, the first and second cylindrical bearing surfaces having the third axis of rotation as the centre line, wherein one of the first and second cylindrical bearing surfaces is provided with a first opening connected to the high-pressure port and the other of the first and second cylindrical bearing surfaces is provided with a second opening connected to the low-pressure port. By providing the bearing surfaces with openings connected to the pressure ports, there is a simple and direct connection between the pressure lines and the chambers.

In accordance with an aspect of the instant invention, the variable pump or hydraulic motor further includes a drive shaft comprising a flange with a set of first plungers on each side of the flange extending in opposite directions. On each side of the flange there is a ring shaped port plate through which the drive shaft extends. In this way a compact high capacity pump or motor is made.

In one advantageous embodiment a pump or hydraulic motor which includes a first axis of rotation rotatable mounted in a housing, first plungers connected to the shaft and rotatable around the first axis of rotation, a port plate mounted in the housing and provided with a port plate surface with a high-pressure port at a first radius and a low-pressure port at the first radius each connected to a respective pressure line, first cylinders rotatable around a second axis of rotation, which intersects the first axis in a centre plane, and sealingly fitted around the first plungers for forming chambers with the first plungers with a volume that in a full rotation changes a stroke volume, cylinder channels each rotatable with and connected to a chamber and ending in a valve surface which is rotatable along the port plate surface for connecting the chamber with the high-pressure port or the low pressure port, whereby by rotating the port plate around a third axis which is perpendicular to the centre plane and intersects the first axis and the second axis, the stroke volume can be changed using a port plate positioning drive located in the centre plane exerting a force on the port plate.

BRIEF DESCRIPTION OF THE DRAWINGS

The invention is explained below with reference to an embodiment and with the aid of a drawing, in which.

DETAILED DESCRIPTION OF THE INVENTION

Figure 1:
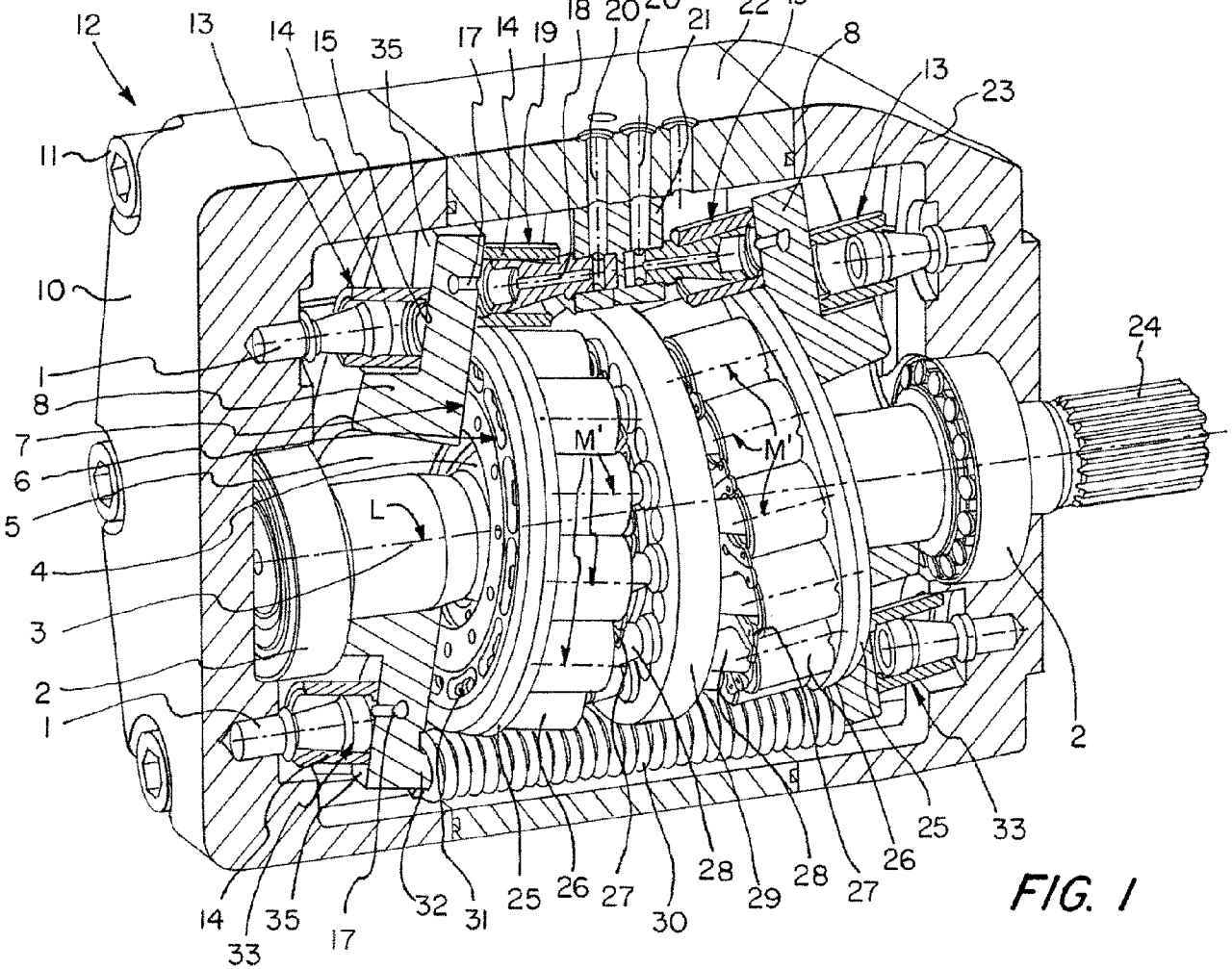
FIG. 1 shows a cross section and the interior of a hydraulic device such as a pump.
Figure 2:
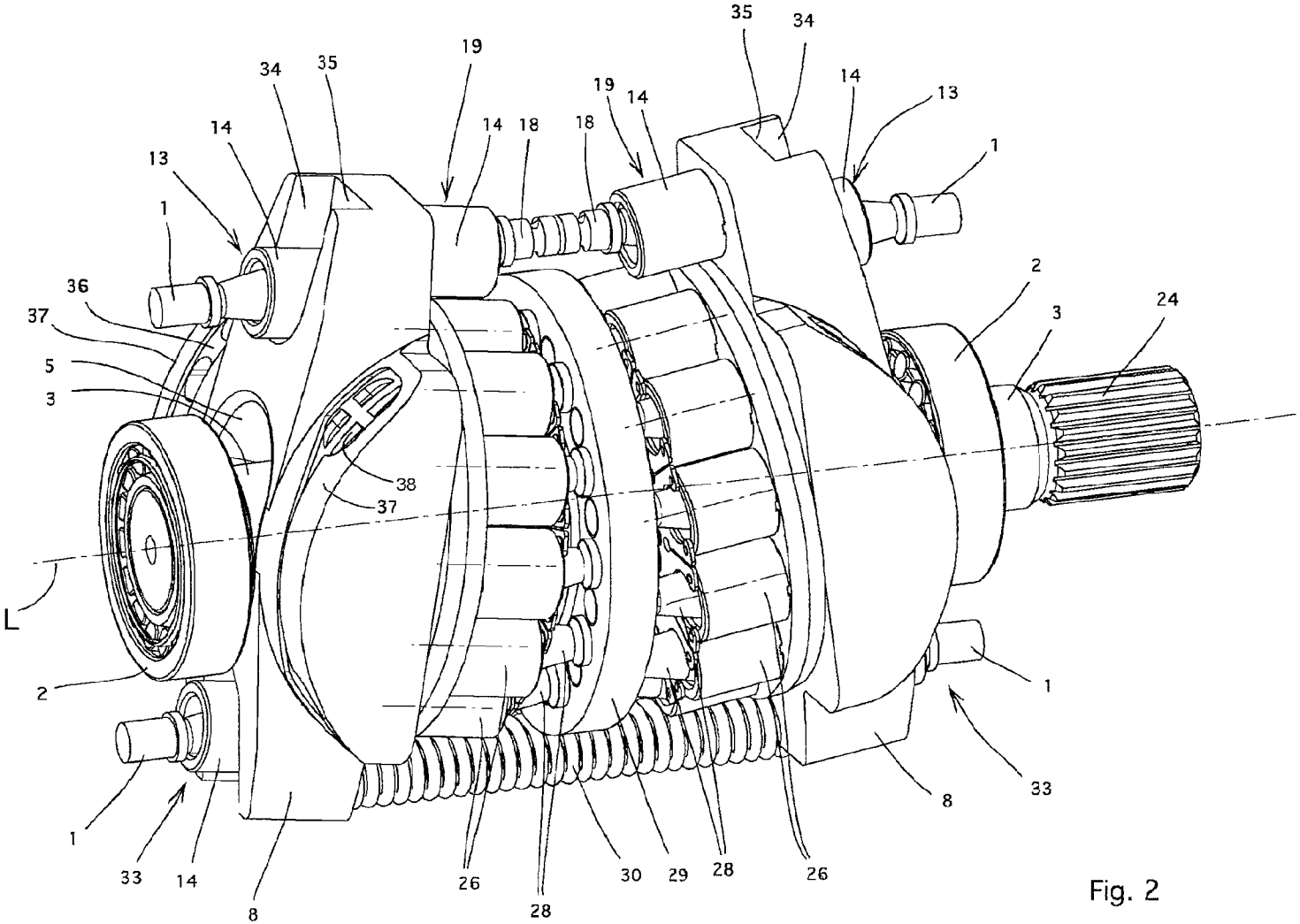
FIG. 2 shows a perspective view of the interior of the hydraulic device of FIG. 1.
Figure 3:
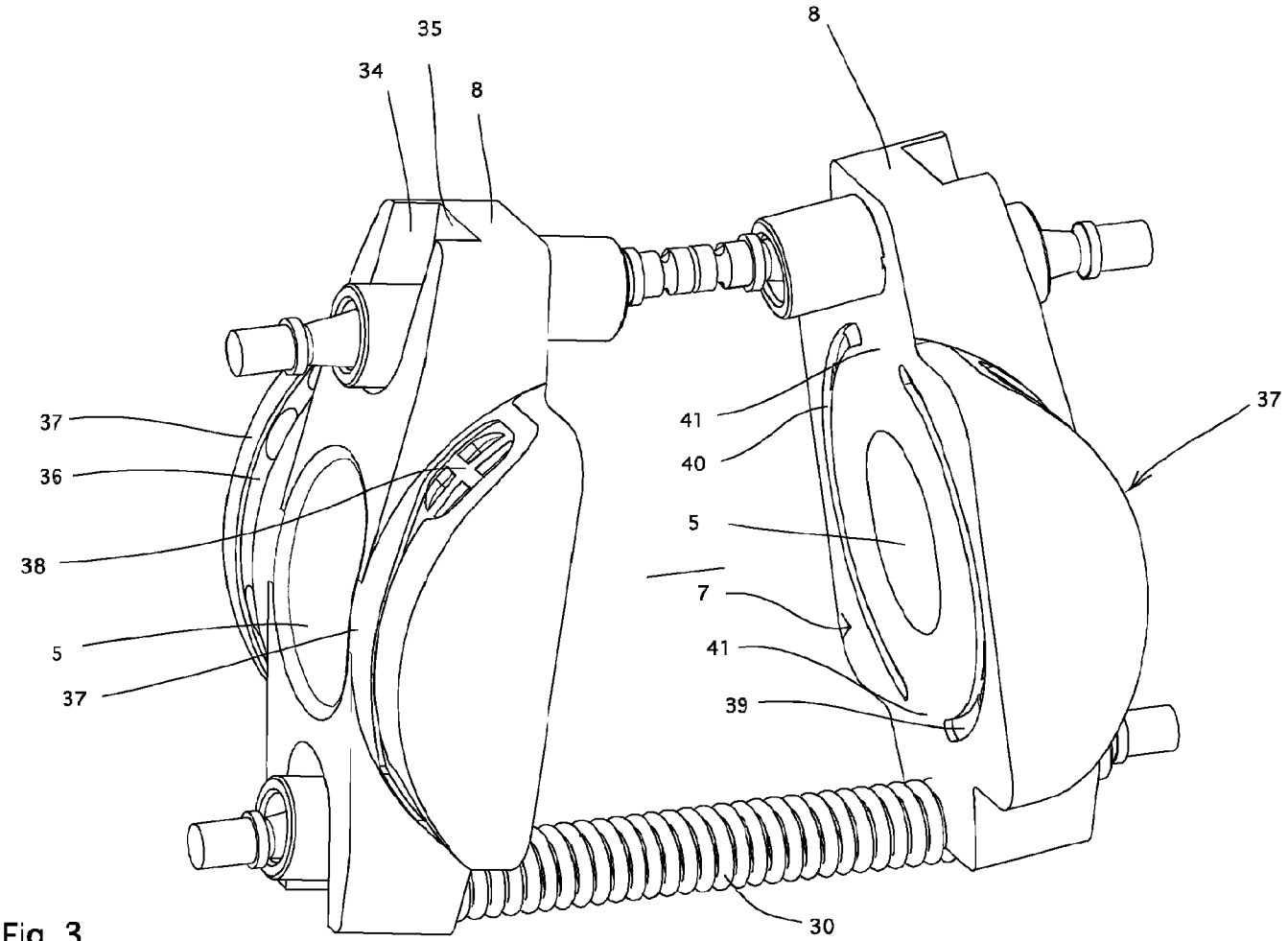
FIG. 3 shows a perspective view of the port plates and the port plate drives of the hydraulic device of FIG. 1.

The hydraulic device shown in FIG. 1 is described below as a pump 12. A motor (not shown) drives the pump 12 via a splined shaft end 24. The pump 12 is connected with pressure lines (not shown) and compresses oil of low-pressure to oil of high-pressure. Using more or less the same components the hydraulic device can be used as a hydraulic motor as well. In that case, oil of high-pressure feeds into the motor and the splined shaft end 24 drives equipment. The document WO 03/058035 describes the various components used in the embodiment in more detail and this description is included herein if required for further explanation of the invention.

The pump 12 comprises a housing 22 on which a first cover 10 and a second cover 23 are fastened with bolts 11, the first cover 10 and the second cover 23 have bearings 2 in which a shaft 3 can rotate around a first axis L. The shaft 3 sealingly extends through the second cover 23 and ends as the splined shaft end 24. The shaft 3 has a flange 29 in the centre of the housing 22 and pump plungers 28 extend on both sides of the flange 29, in this embodiment on both sides twelve pump plungers 28. Pump cylinders 26 enclose the pump plungers 28 and rest against a channel plate 25. The pump plungers 28 have a spherical sealing surface that seals against the inside surface of the pump cylinder 26, so that the inside of the pump cylinder 26 forms a pump chamber with the pump plunger 28. During use, the pump cylinders 26 seal against the channel plate 25 under influence of the pressure in the pump chamber. In order to prevent that leakage occurs in situations where the pressure in the pump chamber is too low a spring 27 is provided, this spring 27 presses the pump cylinders 26 against the channel plate 25. In other embodiments instead or in addition to the spring 27, other locking means hold the pump cylinder 26 against the channel plate 25, thereby maintaining the possibility of a sliding movement of the pump cylinder 26 over the channel plate 25.

Figure 5:
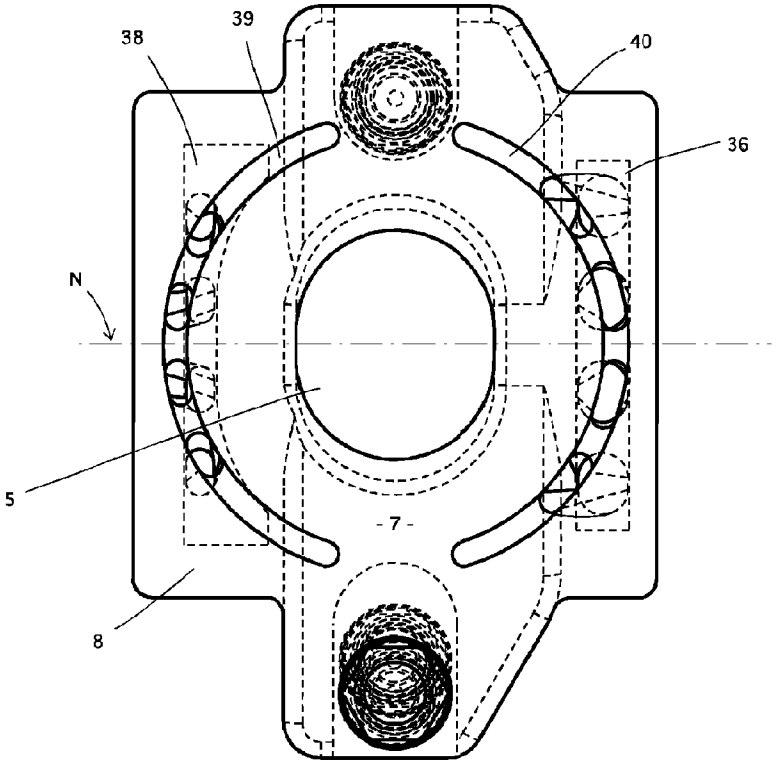
FIG. 5 show a frontal view of the port plate of FIG. 4.
Figure 4:
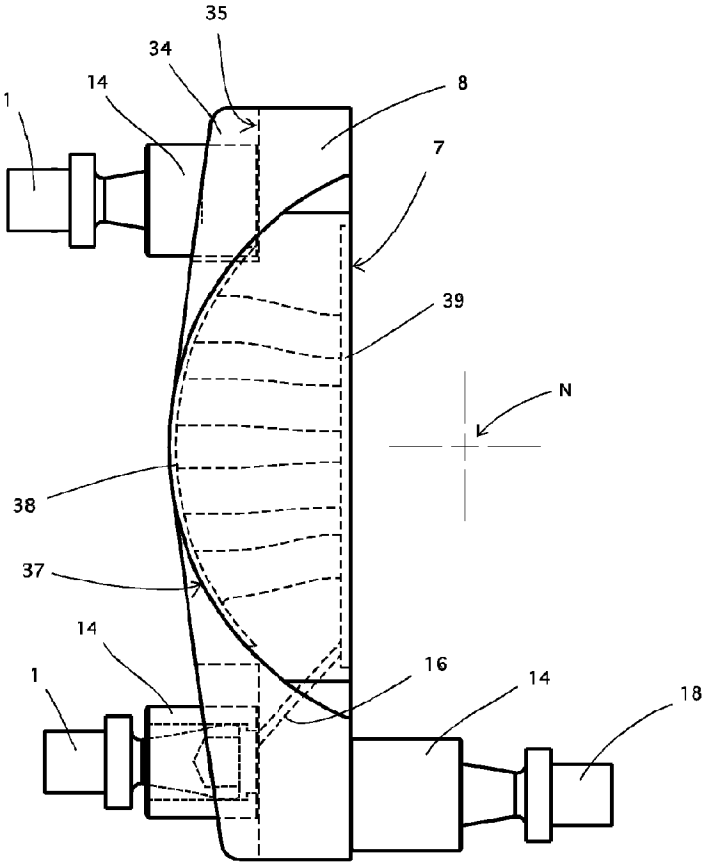
FIG. 4 shows a side view of a port plate of the hydraulic device of FIG. 1.

An opening in the bottom of the pump cylinder 26 connects with a channel 31, which ends at a valve surface 6 of the channel plate 25. The valve surface 6 rotates over a port plate surface 7 of a port plate 8. The channel plate 25 rotates with the shaft 3 and is coupled with the shaft 3 by a sphere shaped coupling 4, so that it can swivel over the coupling 4 and rotate around a second axis M, which intersects the first axis L. The port plate 8 determines the tilt angle of the second axis M. The direction of centre lines M' of the pump cylinders 26 is parallel to the second axis M, so that the sealing surface between a pump plunger 28 and a pump cylinder 26 is perpendicular to the second axis M. The first cover 10 and the second cover 23 and the housing 22 have canals (not shown) that connect the pressure lines with the port plates 8 and so with the pump chambers. Due to the angle between the first axis L and the second axis M in a full rotation of the shaft 3 the volume of the pump chamber changes according to a stroke volume between a maximum value and a minimum value. The stroke volume determines the pump capacity. By rotating the port plate 8 around a third axis N (see FIGS. 4 and 5), which is perpendicular to a centre plane through the first axis L and second axis M and intersects these axis L and M, the angle between the first axis L and the second axis M is changed and with this also the stroke volume and capacity of the pump 12. A first actuator 33 and a third actuator 19 rotate the port plate 8 in a first direction. The first actuator 33 comprises a plunger 1 mounted in the first cover 10. A cylinder 14 is mounted around the plunger 1. To follow the rotation of the port plate 8 the underside of the cylinder 14 can slide over a slide surface 35 which is the bottom of a slot 34 in the port plate 8. An actuator chamber of the first actuator 33, formed by the plunger 1 and the cylinder 14, is open at the bottom and connects with an interconnecting channel 17 in the port plate 8 to a similar actuator chamber of the third actuator 19. The third actuator 19 has a hollow plunger 18 mounted in a support 21 attached to the house 22. A canal through this hollow plunger 18 is part of a control channel 20 that is connected to a control unit (not shown). By increasing oil pressure in the control channel 20, the first actuator 33 and the third actuator 19 rotate the port plate 8 towards a position with a reduced stroke volume. The second actuator 13 comprises a plunger 1 mounted in the first cover 10 and a cylinder 14 slidable over the slide surface 35. The actuator chamber is connected through the opening in the bottom of the cylinder 14 with a high pressure channel 16 in the port plate 8 that connects the actuator chamber with a high-pressure port 39 (see FIGS. 4 and 5). The high-pressure port 39 is connected to the pressure line with oil of high pressure and the second actuator 13 counter acts the torque that is acted by the first actuator 33 and the third actuator 19 on the port plate 8 and the second actuator 13 moves the port plate 8 to a position with an increased stroke volume.

When starting the pump 12 a spring 30 presses the port plates 8 in a tilted position, a spring support 32 positions the spring 30 on the port plate 8. In the tilted position, the stroke volume is maximal during starting. In order to prevent leakage between the cylinders 14 and the port plate 8 the cylinders are pressed by a spring (not shown) against the port plate 8. In another embodiment, there are (additional to or instead of the spring) locking means that hold the cylinders 14 slidingly against the port plate 8. After the pump 12 has started the pressure in the actuator chamber presses the cylinders 14 against the port plate 8. The FIGS. 2, 3, 4 and 5 show the interior of the pump 12 and the port plates 8. Each port plate 8 has in the port plate surface 7 a high-pressure port 39 and a low-pressure port 40, between these ports there is a crossover area 41. The other side of the port plate 8 has a cylindrical bearing surface 37 that rests in a cylindrical support surface (not shown) of the first cover 10 or the second cover 23. The port plate 8 can rotate in this cylindrical support surface around the third axis N. The cylindrical bearing surface 37 that lies opposite the high-pressure port 39 has a high-pressure canal 38 that connects in the port plate 8 with the high-pressure port 39. In the first cover 10 or the second cover 23 the high-pressure canal 38 continues to the high-pressure pressure line. In the same way, the cylindrical bearing surface 37 that lies opposite the low-pressure port 40 has a low-pressure canal 36 that connects to the low-pressure pressure line in the first cover 10 or the second cover 23.

During operation the high-pressure port 39 produces a high oil pressure between the port plate surface 7 and the valve surface 6 at the location of the high-pressure port 39 and a diminishing pressure in the surrounding seal land, that is the surrounding area of the high-pressure port 39 that works as a seal between the high pressure and the pressure-less inside of the pump 12. The high oil-pressure causes a force on the port plate 8 that is more or less completely counteracted by force in the direction of the port plate surface 7 caused by the high pressure in the high-pressure canal 38 in the cylindrical bearing surface 37 and the surrounding seal land. This requirement determines the area of the high-pressure canal 38 in the cylindrical bearing surface 37. The rotating pump cylinders 26 and the rotating channels 31 cause a fluctuating pressure in the crossover area 41 as the pressure changes when a channel 31 changes from the connection with the high-pressure port 39 to the low-pressure port 40 or vice versa. This fluctuating pressure causes a fluctuating force on the port plate 8 and causes fluctuating gaps between the port plate surface 7 and the valve surface 6, which leads to oil leakage that must be as little as possible as it reduces the efficiency of the pump 12. In order to reduce these gaps the first actuator 33 and the second actuator 13 work on the port plate 8 in the direction of the port plate surface 7 and have a direction perpendicular on this surface. In this way, the forces of the first actuator 33 and the second actuator 13 help to close the possible gaps and reduce the deformations of the port plate 8. The first actuator 33 and the second actuator 13 work at a distance from the third axis on the port plate 8, which is equal or larger than the radius of crossover area 41, which also reduces deformations of the port plate 8. Preferably, the positions of the first actuator 33 and the second actuator 13 are such that the stroke of the plungers 1 and 18 in the cylinders 14 is equal or less than the stroke of the pump plungers 28 in the pump cylinders 26, so that the same parts can be used. This means that at a maximum the distance of the first actuator 33 and the second actuator 13 to the first axis L can be twice the radius of the pump plungers 28 around the first axis L.

Placing the actuators at a distance from the third axis N that is greater than the radius of the pressure ports 39 and 40 has the additional advantage that the shaft 3 can extend through a hole in the port plate 8. It is then possible to place several pumps in line with each other whereby the shafts 3 are connected.

The disclosed embodiment shows two sets of pump plungers 28 each working with a port plate 8. This design has the advantage that a small angle between the first axis L and the second axis M obtains a pump of high capacity. It will be clear that the various measures taken to obtain a simple and efficient design are independent from this advantage. In addition, the design of the port plate 8 and the actuators is for instance also suitable for bent axis pumps that have a rotor with cylindrical holes whereby a port plate supports this rotor directly.

What is claimed is:

1. A pump or hydraulic motor comprising a drive shaft with a first axis of rotation rotatably mounted in a housing, first plungers connected to the shaft and rotatable around the first axis of rotation, a port plate mounted in the housing and provided with a port plate surface with a high-pressure port at a first radius and a low-pressure port at the first radius each connected to a respective pressure line, a second axis of rotation which intersects the first axis of rotation in a centre plane, first cylinders rotatable around the second axis of rotation and sealingly fitted around the first plungers for forming chambers with the first plungers, each chamber having a volume that in a full rotation of the first plungers and the first cylinders changes according to a stroke volume, a plurality of cylinder channels, each cylinder channel rotatable with a respective first cylinder and connected to a respective chamber and ending in a valve surface, wherein the valve surface abuts and is rotatable relative to the port plate surface for connecting the chambers through respective cylinder channels with the high-pressure port or the low-pressure port, whereby a bearing supports each port plate in the housing, wherein by rotating the port plate in the housing around a third axis of rotation the stroke volume can be changed using a port plate positioning drive, wherein the third axis of rotation is perpendicular to the centre plane and intersects the first axis of rotation and the second axis of rotation, wherein the port plate positioning drive is located in the centre plane and exerts a force on the port plate and comprises a first hydraulic actuator and a second hydraulic actuator acting on the port plate in a direction parallel to the second axis of rotation and counteracting each other.

2. The pump or hydraulic motor in accordance with claim 1 whereby the first hydraulic actuator and the second hydraulic actuator act on the port plate at a radius equal or larger than the first radius.

3. The pump or hydraulic motor in accordance with claim 1 whereby the first hydraulic actuator is connected to a control unit and the second hydraulic actuator to the high-pressure port.

4. The pump or hydraulic motor in accordance with claim 3 whereby the port plate positioning drive comprises a third hydraulic actuator which is connected to the first hydraulic actuator and which is placed opposite to and counteracting the second hydraulic actuator.

5. The pump or hydraulic motor in accordance with claim 4 whereby the port plate comprises a first canal that connects the first hydraulic actuator and the third hydraulic actuator.

6. The pump or hydraulic motor in accordance with claim 3, whereby the port plate comprises a second canal that connects the second hydraulic actuator with the high-pressure port.

7. The pump or hydraulic motor in accordance with claim 4 whereby the force exerted by the third hydraulic actuator on the port plate is parallel to the second axis of rotation.

8. The pump or hydraulic motor in accordance with claim 7 whereby the first hydraulic actuator, the second hydraulic actuator and the third hydraulic actuator each comprise a second plunger mounted in the housing and a cup shaped second cylinder fitted around the second plunger sealing in a plane perpendicular to the second axis of rotation.

9. The pump or hydraulic motor in accordance with claim 8 whereby the second cylinders are slidable and/or sealingly supported on the port plate.

10. The pump or hydraulic motor in accordance with claim 8, whereby the second cylinder and/or the port plate has spring and/or locking means for preventing a large gap between the second cylinder and the port plate.

11. The pump or hydraulic motor in accordance with claim 8 whereby the first plungers and the first cylinders are identical with respect to the second plungers and the second cylinders.

12. The pump or hydraulic motor in accordance with claim 1 whereby the port plate comprises first and second cylindrical bearing surfaces on a side of the port plate opposite from a side with the port plate surface for supporting the port plate in the housing, the first and second cylindrical bearing surfaces having the third axis of rotation as the centre line, wherein one of the first and second cylindrical bearing surfaces is provided with a first opening connected to the high-pressure port and the other of the first and second cylindrical bearing surfaces is provided with a second opening connected to the low-pressure port.

13. The pump or hydraulic motor in accordance with claim 1 wherein the drive shaft comprises a flange, wherein the first plungers comprise first and second sets of first plungers, wherein each of the first and second set of first plungers extends from an opposite side of the flange, wherein the port plate is a ring shaped port plate, wherein the drive shaft extends through first and second ring shaped port plates disposed on each side of the flange within the housing.

* * * * *